US005603429A

United States Patent [19]

Mulhauser et al.

[11] Patent Number: 5,603,429

[45] Date of Patent: Feb. 18, 1997

[54] MOTORIZED HAND-HELD TRANSPORTABLE DISPENSER FOR DISPENSING DISC-SHAPED OBJECTS ONE AT A TIME

[75] Inventors: Paul Mulhauser; Karl D. Kirk, III, both of New York; Diego Fontayne, Montebello, all of N.Y.

[73] Assignee: Cap Toys, Inc., Bedford Heights, Ohio

[21] Appl. No.: 550,661

[22] Filed: Oct. 31, 1995

[51] Int. Cl.[6] ..... B65D 83/00

[52] U.S. Cl. ..... 221/171; 221/203; 221/258; 221/263; 221/281

[58] Field of Search ..... 221/200, 203, 221/204, 258, 263, 265, 281, 246, 171

[56] References Cited

U.S. PATENT DOCUMENTS

| | | | |
|---|---|---|---|
| 2,330,256 | 9/1943 | Ashton | 221/265 |
| 2,819,814 | 1/1958 | Hatch | 221/258 |
| 3,638,830 | 2/1972 | Belokin, Jr. . | |
| 3,804,294 | 4/1974 | Householder | 221/265 |
| 5,044,516 | 9/1991 | Hoar . | |
| 5,246,136 | 9/1993 | Loidl . | |
| 5,322,185 | 6/1994 | Leight | 221/203 |

FOREIGN PATENT DOCUMENTS

| | | | |
|---|---|---|---|
| 347595 | 1/1979 | Australia | 221/263 |

OTHER PUBLICATIONS

VibroBlock Feeder Systems partial brochure of The Arthur G. Russell Co., Inc.

*Primary Examiner*—H. Grant Skaggs
*Attorney, Agent, or Firm*—Laff, Whitesel, Conte & Saret, Ltd.

[57] ABSTRACT

A transportable, hand-held motorized dispenser having an amusement characteristic includes a disc-shaped housing of a top shell and a bottom shell and a motor driven turntable mounted for unidirectional rotation therein. The housing defines a recess for receiving compartments defined by the turntable for transporting objects supplied to the turntable through an entry slot and for dispensing the objects through a dispensing slot in the wall of the housing, one at a time.

14 Claims, 6 Drawing Sheets

4
50
54
56
60
78
76
49
80
64
62
58
5
5
22
72
34
72
4

50
64A
64A
64B
54
52
62A
56
62
58
78
71
76
72

24
34
70
74

MOTORIZED HAND-HELD TRANSPORTABLE DISPENSER FOR DISPENSING DISC-SHAPED OBJECTS ONE AT A TIME

BACKGROUND OF THE INVENTION

Dispensers of various types exist, including those for dispensing tablets, candy pieces, pills and other objects, including those which are generally disc-shaped. However, there are no such dispensers which are motor operated and easily transportable, and which are also attractive and have an amusement character to them.

For example, there is no available easily transportable motorized dispenser for coated candy objects such as M & M candies.

It would therefore be desirable to provide an attractive, easily operated and readily transportable motorized dispenser capable of reliably dispensing such objects, one at a time, and in prompt succession, and without damaging the objects.

SUMMARY OF THE INVENTION

In accordance with the present invention, a readily transportable motorized dispenser for repeatedly and reliably dispensing objects such as disc-shaped M & M candies, one at a time and in prompt succession, is provided. The dispenser comprises a housing including a generally circular shell means having a circular transport zone defining an annular recess positioned radially outwardly of the center of the shell means, a circular turntable mounted in the housing for rotation therein and defining a series of circumferentially spaced adjacent compartments, each compartment being adapted to receive and contain one object, the compartments being disposed within and embraced by the recess for transporting the objects as the turntable is rotated, the turntable further defining a central platform for receiving and supporting a supply of the objects, the shell means defining an entry slot for permitting the objects, one at a time, to transfer in a predetermined orientation from the platform into a compartment, and battery operated motor means in the housing for rotating the turntable relative to the housing and the shell means, and a discharge slot defined by the housing for allowing an object in a compartment to be discharged to the exterior of the housing as the compartment rotates past the discharge slot. Desirably, the housing includes a bottom shell mounting the motor means, and the discharge slot is defined by the bottom shell, and the shell means and bottom shell are secured to each other and contain and mount the turntable for rotation therein. The turntable may define a ring gear and the motor means may include a drive gear engaging the ring gear for rotating the turntable.

In a preferred form, the platform is circular, dished and slopes downwardly from its center to promote movement of the objects towards the circular transport zone and the platform defines a series of circumferentially spaced lead-in notches, each for supporting and promoting a predetermined orientation of an object for permitting the object to pass through the entry slot into a compartment. The shell means desirably defines a central loading opening and the motorized dispenser further desirably comprises a removable lid closing the loading opening. In a preferred form the turntable defines a series of circumferentially spaced fingers, each pair of which straddles a floor for supporting an object as it is transported between the entry and discharge slots and the floors are inclined downwardly and outwardly to promote discharge of the objects through the discharge slot.

Further objects, features and advantages of the present invention will become apparent from the following description and drawings.

DETAILED DESCRIPTION OF A PRESENTLY PREFERRED EMBODIMENT

Figure 1:
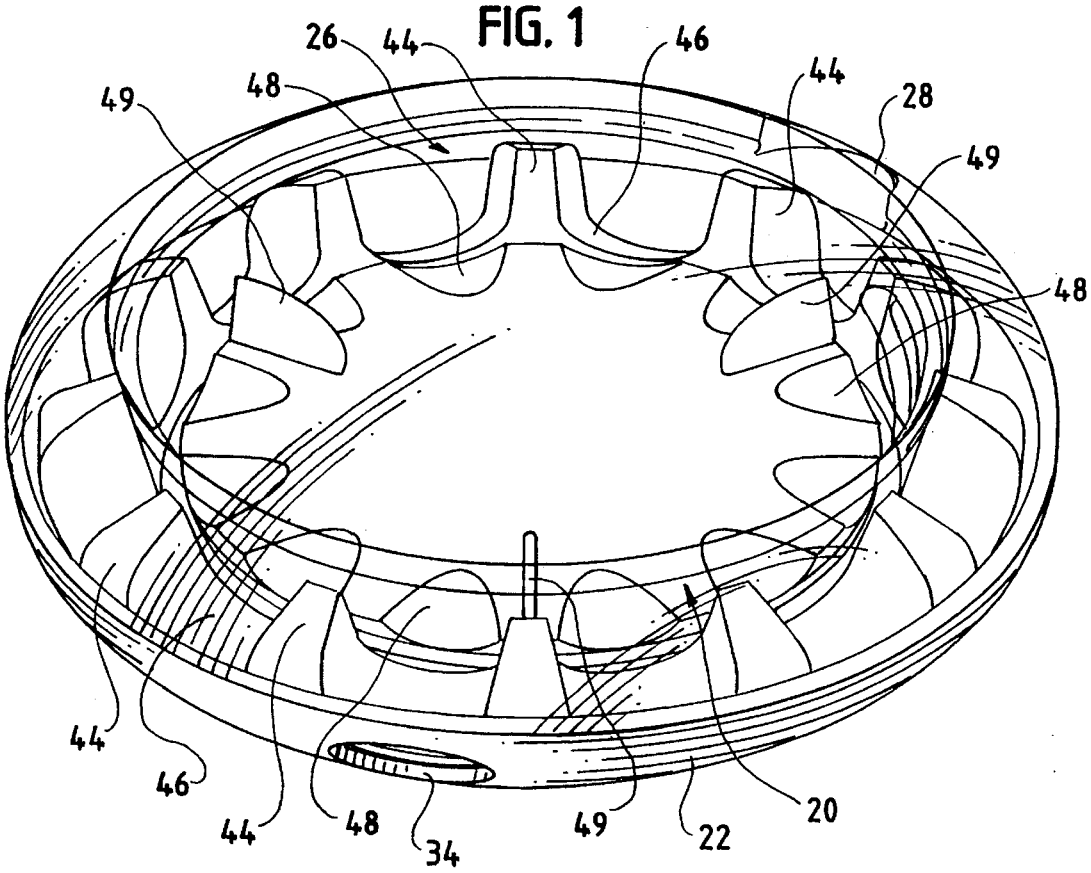
FIG. 1 is a perspective view of a dispenser of the present invention.

Referring now to the drawings, a hand-held, motorized dispenser 10 for repeatedly dispensing objects, such as ellipsoid or disc-shaped candy objects, in accordance with the present invention comprises a disc-shaped housing defined by shell means such as a top shell 20 and a bottom shell 22. Shells 20, 22 are typically of plastic and are adapted to be secured to each other around their confronting peripheries, as in a snap fit or in a permanent fit, as by using an ultrasonic welding technique. The top shell 20 defines a central loading opening 24 which is proportioned to receive a circular lid 26, as in a snap fit. Lid 26 may be decorated as with a logo as desired. Lid 26 is removable so that candy or other comestibles or objects, may be loaded into the housing for subsequent dispensing. The top shell 20, at its top, defines a notch 28 which facilitates prying of the lid 26 out of engagement with the top shell 20 so that loading and filling may proceed.

Top shell 20 is generally circular in shape and has a circular transport zone defining a downwardly opening recess 30 which becomes progressively wider and which is positioned radially outwardly of the center of the top shell. The inner wall defining recess 30 defines an elongated receiving or entry slot 32. The shape and size of the window or slot 32 may be proportioned to the objects to be dispensed so that the slot will receive it, preferably generally in the orientation in which it is to be dispensed and preferably one at a time, and at a desired peripheral location. The length of slot 32 is greater than the greatest dimension of the objects to be dispensed.

The bottom shell 22 of the housing defines a dispensing slot 34 in its outer wall and at a peripheral location offset from slot 32. Slot 34 is proportioned to permit the objects to be dispensed therethrough in a predetermined desired orientation.

As may be seen from the drawings, window or slot 32 has a length which is approximately two and one-half times the length of a compartment. As such, two compartments can be filled at the same time. The height of the slot 32 of the leading end is greater than the minimum dimension of the object. The depth of the compartment between the fingers 44 may be less or greater than the greatest dimension of the object. Other objects may project into the compartments through the slot as they are being filled. As the turntable 40 continues to rotate to the zone of the slot 32 which tapers and decreases in vertical height, the edges of the slot 32 tend to cam projecting objects out of the compartment and radially inwardly of the platform 42 and tend to cam the object in the compartment to a more upstanding position.

Figure 8A:
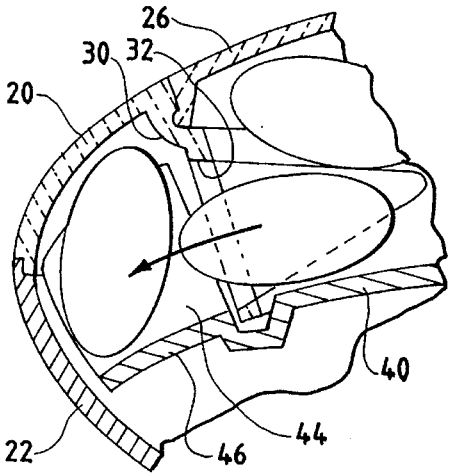
FIGS. 8A to 8D are schematic, fragmentary views showing ellipsoid candies in diametric cross section and how they are transferred and oriented relative to the turntable and the entry slot for subsequent transport to a discharge slot.
Figure 8B:
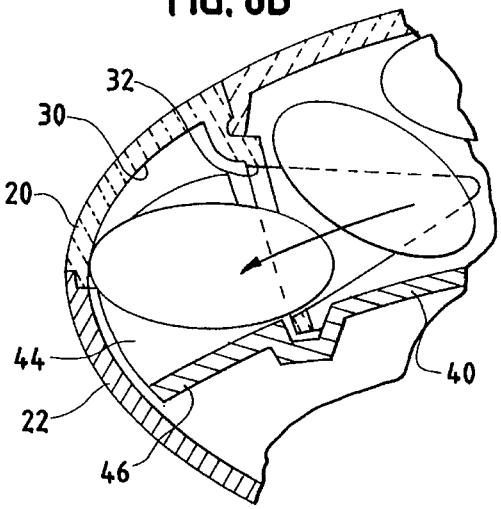
Figure 8C:
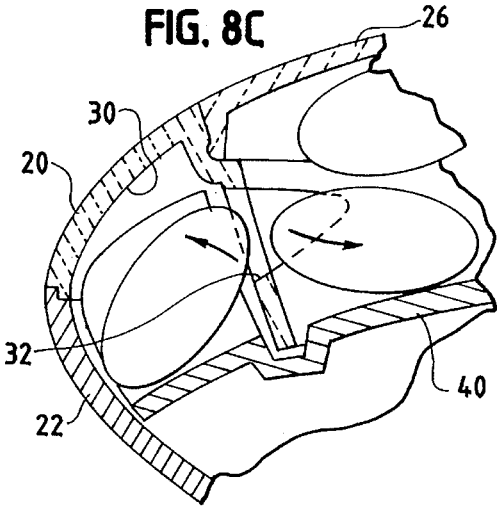
Figure 8D:
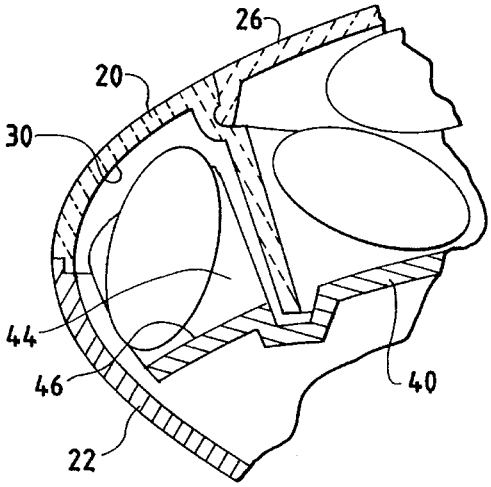

FIGS. 8A to 8D, illustrate how, in one form of the dispenser 10, disc-shaped or ellipsoid objects such as M & M candies may be transferred into and oriented in the compartments for transport to the dispensing opening 34. In FIGS. 8A and 8B, either are disc-shaped object or two are moved into the compartment through slot 32. As the turntable 40 continues to move to the position of FIG. 8C, the tapering portion of the slot 32 begins to cam objects which have not completely entered the compartments outwardly and to cam objects in the compartment upwardly for transport, as in the position illustrated in FIG. 8D to the dispensing opening.

Figure 2:
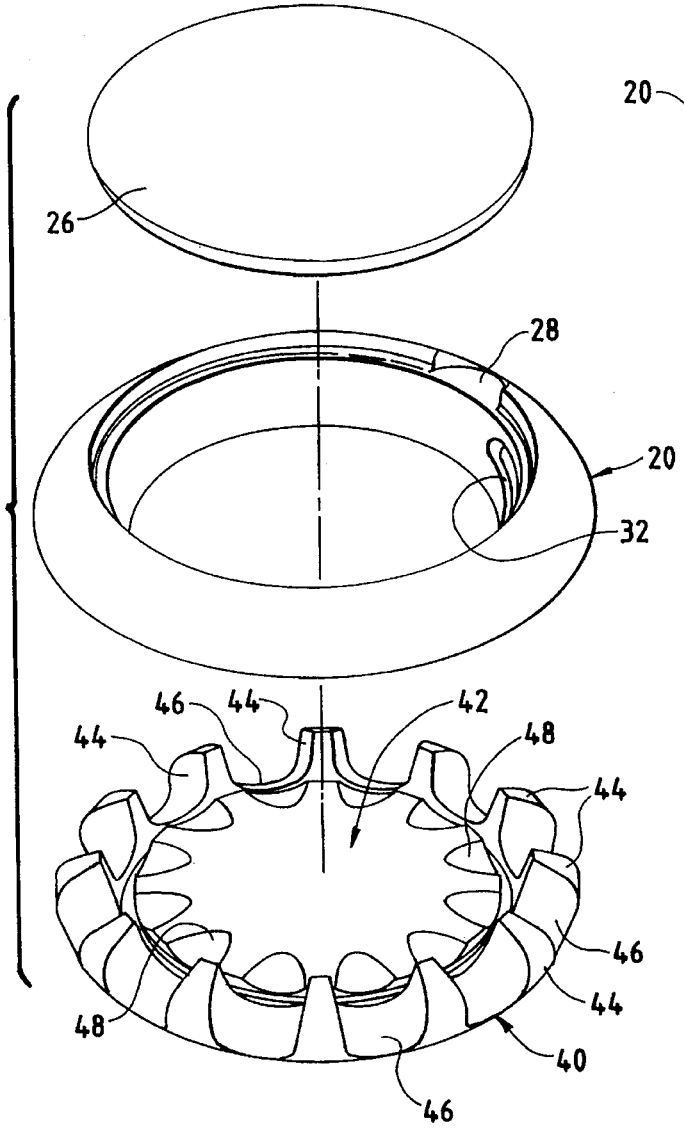
FIG. 2 is an exploded perspective view of portions of the dispenser of FIG. 1.
Figure 2A:
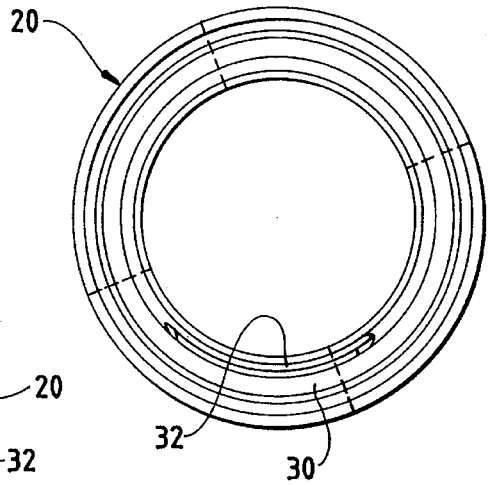
FIG. 2A is a bottom view of the shell of FIG. 2.
Figure 2B:
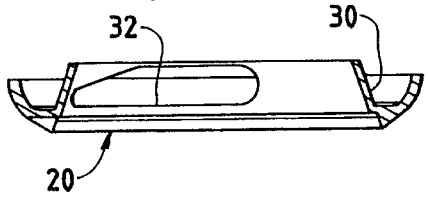
FIG. 2B is a fragmentary sectional view of the shell of FIG. 2A showing the entry slot therein.
Figure 3:
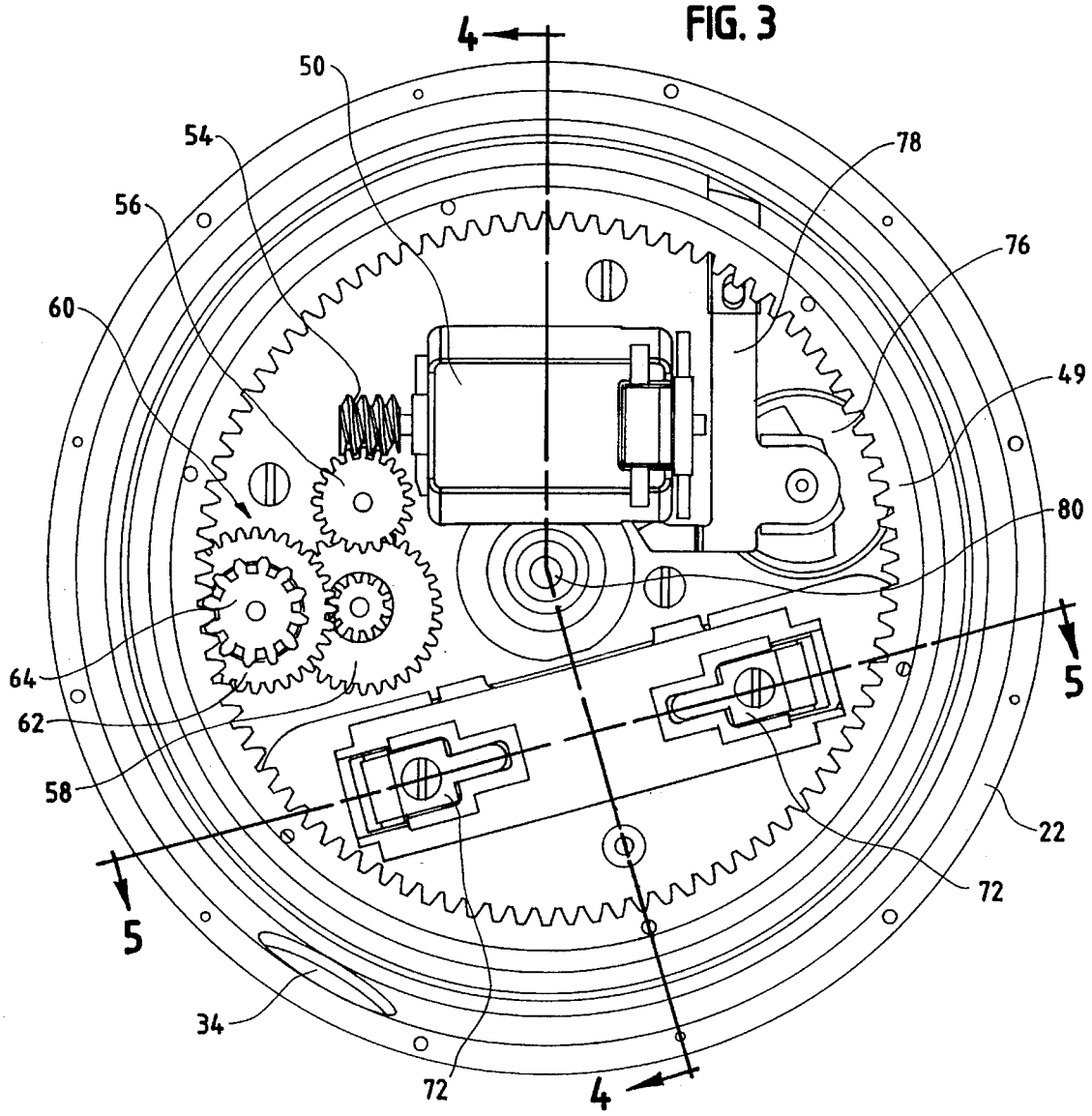
FIG. 3 is a top plan view of the bottom shell and drive assembly of the dispenser of FIG. 1.
Figure 4:
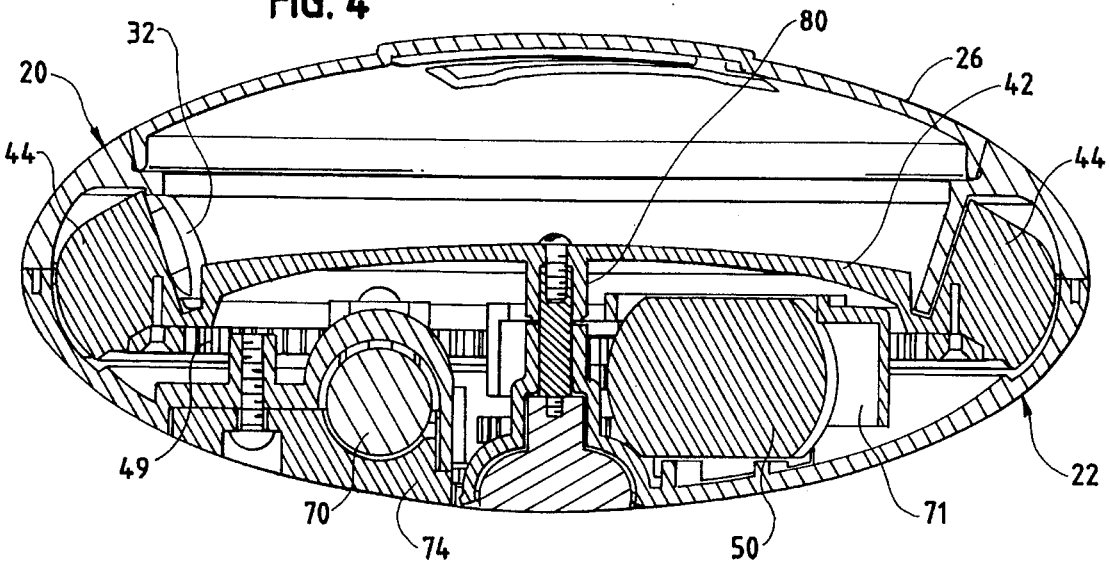
FIG. 4 is a cross-sectional view of the dispenser of FIG. 1 taken substantially along line 4—4 of FIG. 3.

The recess is positioned and proportioned to cooperate with a rotatable turntable 40. Turntable 40 is mounted in the housing, is circular in shape and defines an inner central platform 42 which is downwardly and outwardly dished for receiving and supporting a supply of the objects. Turntable 40 defines a plurality of upwardly projecting circumferentially-spaced fingers 44, pairs of which define a series of circumferentially adjacent pockets or compartments for receiving, containing and transporting objects to be dispensed between slots 32 and 34. The fingers 44, as will be appreciated from FIGS. 1 and 2, are spaced apart and with the floors 46 straddled by them are proportioned to matingly receive and support the objects. To facilitate and promote the proper orientation of the objects and to enhance the ease with which objects will enter the compartments defined by fingers 44 and floor 46, circumferentially spaced, dished lead-in notches 48 are positioned adjacent each floor 46. A series of radial ribs 49 for stirring objects to be dispensed may be provided.

Figure 5:
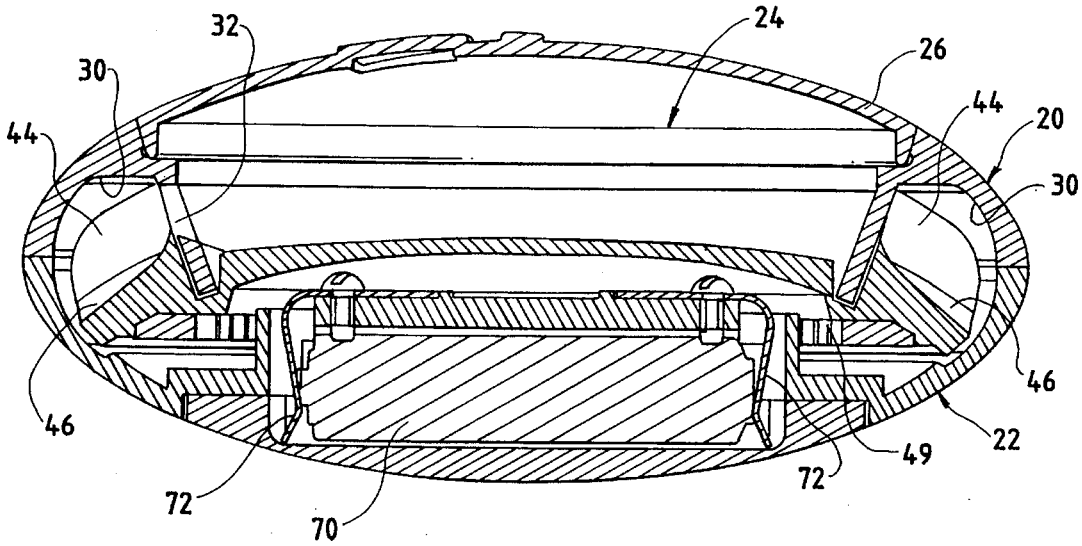
FIG. 5 is a cross-sectional view of the dispenser of FIG. 1 taken substantially along line 5—5 of FIG. 3.
Figures 6, 7:
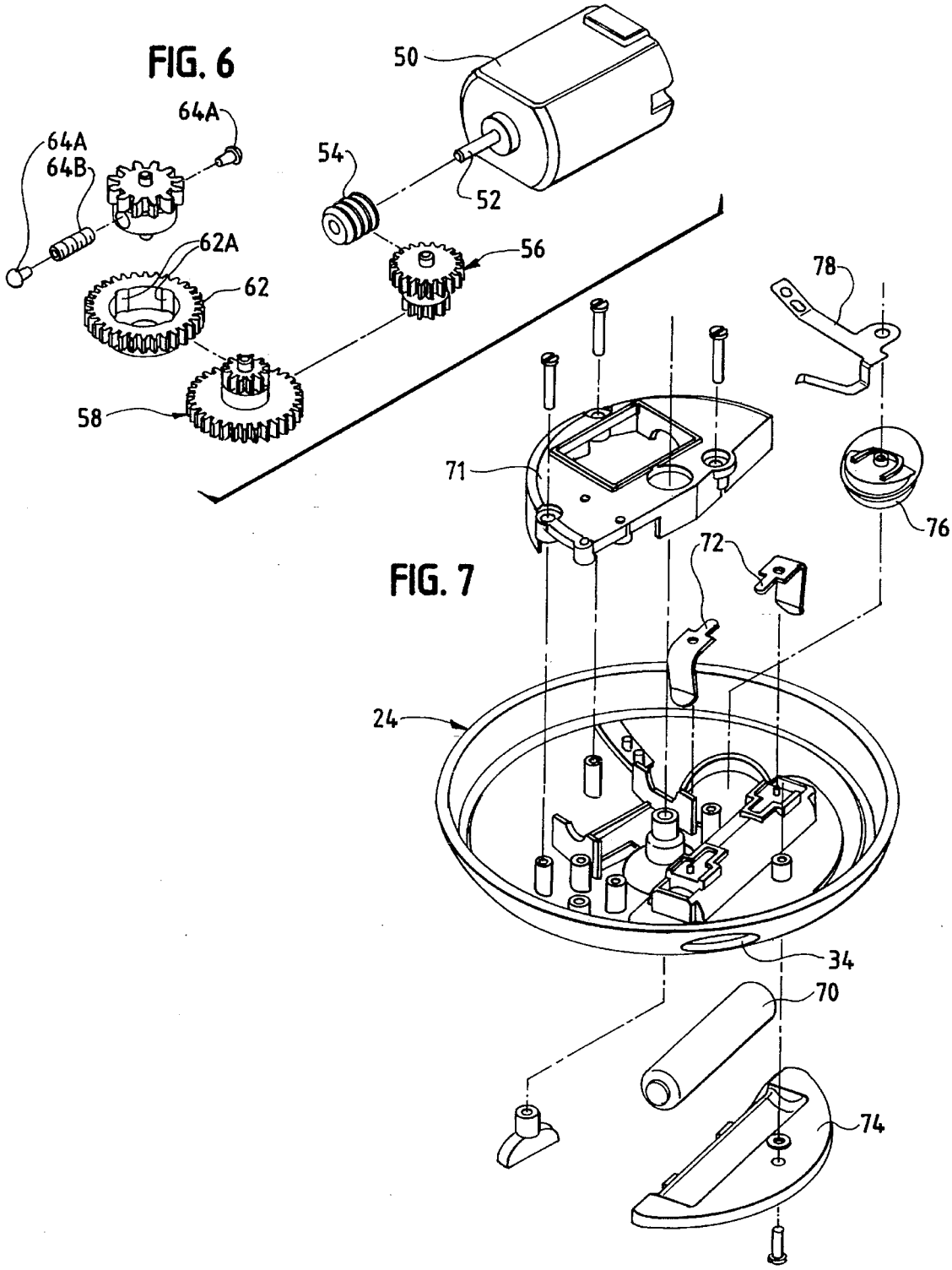
FIG. 6 is an exploded view of the motor and drive train assembly shown in FIG. 3.
FIG. 7 is an exploded view of certain of the elements of FIG. 3.

As will be appreciated from the drawings, turntable 40 is adapted to be rotated unidirectionally, as in a counterclockwise direction, relative to and within the housing, and in particular with the fingers and compartments within and embraced by the recess 30. In this manner, objects disposed between fingers 44 will be retained against escape as they are transported between slots 32, 34 as the turntable rotates. When a compartment sans an object reaches slot 32, and if an object is properly oriented and made ready for transfer from platform 42, it will rest in part on a lead-in notch 48 and will then slide through slot 32 and onto a floor 46 between a pair of associated fingers 44. The object will continue to be carried and transported by the turntable until the compartment confronts dispensing slot 34 at which time the object will slide out through slot 34. To promote discharge of the objects, the floors 46 are inclined downwardly and outwardly (as best seen in FIG. 5). Subsequent dispensing will occur in the same manner as those compartments which have received objects are moved by the turntable to the location of dispensing slot 34 for discharge to the exterior of the housing.

The bottom shell 24 of the housing 10 houses and mounts the power supply and motor for rotating the turntable 40. The motor 50 is a conventional motor adapted to be powered by a 1.5 Volt AAA battery 70, such as an alkaline battery. The motor drive shaft 52 may be fitted with a worm gear 54 which drives a suitable speed-reducing gear train, including a first compound gear 56, a second compound gear 58 and a clutch gear 60, including a first annular clutch member 62 defining a series of circumferentially spaced recessed clutch elements 62A and a second clutch member 64 which drives the turntable 40 relative to the housing. Drive or clutch gear 64 employs a pair of clutch pins 64A loaded by a metal coil spring 64B. The heads of pins 64A mate with clutch elements 62A and permit slippage when there is an overload condition. The motor may rotate the turntable at a rate of about 7 revolutions per minute so that about 84 objects may be discharged per minute. Of course, other speeds can be used.

Clutch gear 64 serves to drive and rotate the turntable via a ring gear 49 on a lower face thereof. The turntable 40 is supported and mounted centrally on a hub 80.

The motor 50 may be supported on a suitable mounting plate 71. The battery 70 is adapted to be supported between a pair of contacts 72 which in turn are wired to the motor in a conventional manner. The battery 70 is enclosed by a battery door 74. The motor is actuated by an actuator or push button 76 which causes power from battery 70 to be applied to the motor through motor contact 78. As is apparent from the drawings, the mounting plate contacts gears and battery door are all secured to the bottom shell with fasteners, such as screws, in a known manner.

The gears, clutch elements and turntable may be of suitable injection molded plastics, such as of an acetal resin. The shells, lid battery doors, push button and mounting plate may be of an injection molded ABS plastic. The lid and top shell are desirably transparent, while the bottom shell and its associated parts may be of a suitably colored formulation. The battery contacts and motor contact may be of nickel plated cold rolled steel.

It will be apparent from the foregoing that a simple but dependable battery-operated, motorized dispenser has been provided. It may repeatedly and continuously dispense objects, such as disc-shaped candy objects, in prompt succession, or may be operated intermittently to discharge only one object when that is desired. It is easily refilled and dependably discharges the objects. Its construction is simple and its configuration minimizes any possibility of damaging the dispenser or objects to be dispensed. It is easily transportable. In a typical embodiment, dispenser 10 may be about 4 inches in diameter and about 1.75 inches in height. It may be made in attractive configurations and lends itself to a variety of color combinations, with transparent portions for viewing of the interior, such as for the top shell and lid, and therefore has a significant amusement capability.

Although the dispenser 10 is specially configured for dispensing M & M candies, it may also be used for other candy varieties, such as Skittles, Reeses Pieces, bubble gum balls, etc. The entry and dispensing slots and turntable may need to be modified if the dimension and sizes of the objects to be dispensed so dictate.

Although but one embodiment has been illustrated, it will be apparent to those skilled in the art that modifications may be made without departing from the spirit and scope of the invention. Thus, the invention is not to be considered as being limited, except as may be made necessary by the appended claims.

What is claimed:

1. A hand-held transportable motorized dispenser for repeatedly dispensing objects comprising:

a housing including a generally circular shell means having a circular transport zone defining an annular recess positioned radially outwardly of the center of the shell means, a circular turntable mounted in said housing for rotation therein and defining a series of circumferentially spaced adjacent compartments, each compartment being adapted to receive and contain one object, said compartments being disposed within and embraced by said recess for transporting said objects as said turntable is rotated, said turntable further defining a central platform for receiving and supporting a supply of said objects, said shell means defining an entry slot for permitting said objects, one at a time, to transfer in a predetermined orientation from said platform into a said compartment, and battery operated motor means in said housing for rotating said turntable relative to said housing and said shell means, and a discharge slot defined by said housing for allowing an object in a compartment to be discharged to the exterior of said housing as said compartment rotates past said discharge slot.

2. The motorized dispenser in accordance with claim 1, and wherein said housing includes a bottom shell mounting said motor means, and said discharge slot is defined by said bottom shell, and wherein said shell means and bottom shell are secured to each other and contain and mount said turntable for rotation therein.

3. The motorized dispenser in accordance with claim 1, and wherein said turntable defines a ring gear and said motor means includes a drive gear engaging said ring gear for rotating said turntable.

4. The motorized dispenser in accordance with claim 1, and wherein said platform is circular, dished and slopes downwardly from its center to promote movement of the objects towards said circular transport zone.

5. The motorized dispenser in accordance with claim 4, and wherein said platform defines a series of circumferentially spaced lead-in notches, each for supporting and promoting a predetermined orientation of an object for permitting said object to pass through said entry slot into a said compartment.

6. The motorized dispenser in accordance with claim 1, and wherein said shell means defines a central loading opening and said motorized dispenser further comprises a removable lid closing said loading opening.

7. The motorized dispenser in accordance with claim 1, and wherein said motor means further comprises an actuating button for providing power thereto.

8. The motorized dispenser in accordance with claim 1, and wherein said turntable defines a series of circumferentially spaced fingers, each pair of which straddles a floor for supporting an object as it is transported between the entry and discharge slots.

9. The motorized dispenser in accordance with claim 8, and wherein said floors are inclined downwardly and outwardly to promote discharge of the objects through the discharge slot.

10. The motorized dispenser in accordance with claim 1, and wherein said housing includes a bottom shell mounting said motor means, and said discharge slot is defined by said bottom shell, wherein said shell means and bottom shell are secured to each other and contain and mount said turntable for rotation therein, wherein said platform is circular, dished and slopes downwardly from its center to promote movement of the disc-shaped object towards said circular transport zone, wherein said shell means defines a central loading opening and said motorized dispenser further comprises a removable lid closing said loading opening, and wherein said motor means further comprises an actuating button for providing power thereto.

11. The motorized dispenser in accordance with claim 10, and wherein said turntable defines a series of circumferentially spaced fingers, each pair of which straddles a floor for supporting an object as it is transported between the entry and discharge slots.

12. The motorized dispenser in accordance with claim 11, and wherein said floors are inclined downwardly and outwardly to promote discharge of the objects through the discharge slot.

13. The motorized dispenser in accordance with claim 1, and wherein said entry slot has a first portion which is of a first height and a second section which tapers to a reduced height at the trailing end for camming an object in a compartment to a desired position.

14. The motorized dispenser in accordance with claim 13, and wherein each compartment is of a radial depth sufficient to receive a portion of a second object, and the trailing end of said slot is adapted to cam a said second object out of a said compartment.

* * * * *